US006302238B1

(12) United States Patent
Preusser et al.

(10) Patent No.: US 6,302,238 B1
(45) **Date of Patent: *Oct. 16, 2001**

(54) SUPPORT STRUCTURE FOR SUSPENDING A WORK SURFACE BELOW A GIRDER

(76) Inventors: Mark A. Preusser; David L. Espenchied, both of 1222 Kelly Ave., NW., New Philadelphia, OH (US) 44663

( * ) Notice: Subject to any disclaimer, the term of this patent is extended or adjusted under 35 U.S.C. 154(b) by 0 days.

This patent is subject to a terminal disclaimer.

(21) Appl. No.: 09/788,882

(22) Filed: Feb. 20, 2001

Related U.S. Application Data

(63) Continuation of application No. 09/353,400, filed on Jul. 15, 1999, now Pat. No. 6,227,330.

(51) Int. Cl.[7] ..... E04G 3/10; E04G 3/14; E04G 3/00

(52) U.S. Cl. ..... 182/150; 182/36; 248/228.6

(58) Field of Search ..... 182/150, 36, 82, 182/37; 248/228.6, 228.1; 104/111

(56) References Cited

U.S. PATENT DOCUMENTS 852,784 * 5/1907 Hannaford ..... 104/111
1,086,329 * 2/1914 Liess ..... 182/38 X
1,929,325 * 10/1933 Masterson ..... 182/36 X
2,067,344 * 1/1937 Ringe ..... 182/36 X
3,072,072 * 1/1963 Mc Donough ..... 104/111 X
3,524,520 * 8/1970 Tidwell ..... 104/111 X
3,550,723 * 12/1970 Gentry ..... 182/36
3,929,078 * 12/1975 Sears ..... 104/111
4,848,516 * 7/1989 Nakai et al. ..... 182/36
5,048,640 * 9/1991 Mc Conville et al. ..... 182/150 X
5,537,933 * 7/1996 Ablad ..... 182/36 X
5,839,539 * 11/1998 Smith ..... 182/150

* cited by examiner

*Primary Examiner*—Daniel P. Stodola
*Assistant Examiner*—Hugh B. Thompson
(74) *Attorney, Agent, or Firm*—Sand & Sebolt

(57) ABSTRACT

A support structure for moveably suspending a work surface from the underside of a bridge includes at least a first clip mounted on each lower web of a pair of parallel bridge girders, a track mounted on each clip, and a scaffold member rollably suspended from the track, the work platform extending between the scaffold members. The scaffold members include a plurality of rollers that roll along the upper surface of each track such that the scaffold members are selectively rollable along the tracks. The clips are securely clamped to the lower webs of the girders such that the rails are securely and unadjustably spaced below the lower webs of the girders.

26 Claims, 13 Drawing Sheets

SUPPORT STRUCTURE FOR SUSPENDING A WORK SURFACE BELOW A GIRDER

CROSS REFERENCE TO RELATED APPLICATION

This is a continuation of application Ser. No. 09/353,400 filed Jul. 15, 1999, now U.S. Pat. No. 6,227,330.

BACKGROUND OF THE INVENTION

1. Technical Field

The invention relates generally to devices that provide moveable work platforms underneath a bridge and, more particularly, to devices that permit work platforms to be moveably suspended from the underside of a bridge. Specifically, the invention relates to a suspension device that provides a pair of rails clamped to the lower webs of parallel bridge girders, with a scaffold member being rollably mounted on each rail, and with the work platform being built upon and extending between the two scaffold members.

2. Background Information

Bridges are used for numerous purposes in modern society. Bridges often carry roadways or railroad tracks over natural obstacles such as rivers and valleys and are also used as overpasses to permit one roadway to cross another without intersection. Bridges thus facilitate the uninterrupted flow of traffic along roadways and railways.

Many bridges, particularly those upon which automobiles and trucks travel, provide a roadway surface at the top thereof. Such bridges typically include a plurality of piers extending vertically upward from the natural obstacle or roadway to be traversed by the bridge, a plurality of horizontal parallel and spaced apart girders supported on top of the piers and extending between the piers and to the grade adjacent the terminal ends of the bridge. A roadway, typically constructed of concrete, is constructed on top of the girders. Bridges may also include trusses and suspension systems in addition to or in the alternative to piers. The design and construction of such bridges is well known and understood in the relevant art.

Bridges also typically require periodic maintenance to ensure their continued structural stability and utility. Bridges having a roadway at the upper surface thereof often require maintenance of the roadway surface at least as often as conventional roadway surfaces that are constructed above grade. More particularly, bridge roadway surfaces often require more frequent maintenance inasmuch as such roadways experience higher mechanical stresses than non-elevated roadways. Such enhanced mechanical stresses occur due to the loading that results from supporting a roadway across parallel and spaced girders instead of from a continuous roadbed, as well as due to the quicker thermal expansion and contraction that results from both the upper and lower surfaces of the roadway being exposed to the atmosphere. Such bridge-borne roadways thus require frequent maintenance and are sometimes in need of complete replacement.

The replacement of a bridge-borne roadway begins with the complete removal of the old roadway. Such removal occurs with the use of jackhammers and heavy equipment to completely remove the roadway until only the girders remain, the girders being supported by piers and/or other support structures. Planar construction forms are then installed in the spaces between the girders such that the construction forms and the girders together constitute a single generally planar surface upon which the roadway can be constructed. The new roadway is constructed on the surface by constructing a network of steel reinforcement rods a few inches above the surface and then by pouring concrete over the surface to encapsulate the reinforcement rods in the concrete.

Once the concrete roadway has cured, the construction forms must be removed from the underside of the roadway. Inasmuch as the new roadway extends across the top of the bridge, with the girders and construction forms being underneath the new roadway, the construction forms must be removed from the underside of the bridge. Inasmuch as the bridge is elevated above a natural obstacle or another roadway, the workmen removing the construction forms must stand upon an elevated work platform that is supported either by a scaffolding or other structure from below or is suspended by a structure attached to the underside of the bridge. Such an elevated work platform must be readily moveable to allow the workmen to reach all areas of the underside of the bridge, and must additionally be secure enough to prevent the workmen from falling. While ground-based support structures such as scaffolding and scissor platforms provide excellent stability and safety, the utility of such devices is limited inasmuch as most bridges traverse natural obstacles such as rivers or extend over roadways that must continue to carry traffic. As such, a support structure that suspends the work platform from the underside of the bridge provides the most versatility in removing the construction forms.

One type of structure for supporting a work platform from the underside of a bridge is presented in U.S. Pat. No. 5,839,539 to Smith. Smith discloses a support structure that includes a plurality of hangers that are positioned at the lower web of a girder, with each hanger including an upward-facing roller. Once each of the hangers is adjusted such that the rollers are each at a common height, a scaffolding member having an inverted U-shaped channel is installed onto a plurality of the rollers such that the rollers are received within the U-shaped channel. While the structure disclosed in Smith has achieved limited success for the objectives presented therein, the Smith device has not been without limitation.

As an initial matter, the hangers disclosed in Smith do not clamp directly to the web at the underside of the girder, but rather hang loosely from the lower web without being clamped thereto. In operation, it is anticipated that the scaffolding member will roll along the rollers from one hanger to another to allow the platform carried by the scaffolding member to move along the length of the bridge. One problem associated with the Smith device, however, is that a minor maladjustment in the hanger can cause the scaffolding member approaching one of the rollers to strike the roller instead of rolling smoothly over the top of the roller. Such a strike often results in the hanger being pushed out of alignment with the other rollers inasmuch as the hanger is not securely clamped to the web of the girder. Additionally, the adjustment of each of the hangers in an attempt to align each of the rollers is both time consuming and often ineffective inasmuch as the hangers are only loosely supported from the girders and are not securely clamped thereto.

The looseness of the hangers often requires a user to install successive hangers onto the girders as the scaffold member is advanced. More specifically, the successive hangers are installed by workmen reaching in the forward direction off the scaffold member to install a successive hanger onto the girder, with the workmen then advancing the scaffold member to roll along the newly installed successive hanger. Such a methodology is known in the relevant industry as "leapfrogging" and is both labor intensive and slow inasmuch as the hangers are not all installed in a single procedure. While the hangers of the Smith reference could, potentially, all be installed in a single procedure, the loose support of the hangers often results in one or more hangers falling from the girder due to wind, vibration, and other typically encountered phenomena. As such, as the scaffold member is moved along the underside of the girders, with the hangers being removed from behind the scaffold member after the scaffold member has traversed them and then being reinstalled ahead of the scaffold member to permit the scaffold member to incrementally move in the forward direction. Inasmuch as the hangers are removed after the scaffold member has passed over them, the movement of the scaffold member cannot be reversed unless the hangers are reinstalled in a reverse-leapfrogging fashion.

Additionally, inasmuch as the hangers of the Smith reference align with the opposite edges of the lower web of the girder, a junction plate extending between the ends of girders butted together creates special problems for the Smith hanger inasmuch as such extension plates often protrude outwardly from the edges of the lower web. In such a circumstance, the rollers of the hangers adjacent the junction plate will be misaligned with the other hangers on the girder. Alternatively, each of the hangers can be spaced the same distance away from the edges of the lower web to ensure that the rollers traversing the junction plate are aligned with all of the other rollers. Such a solution causes the hangers to be even more loosely attached to the girder, increasing the likelihood that the hangers will become knocked into misalignment due to contact between the scaffold member and each successive roller. Such misalignment prevents the scaffold member from rolling along the rollers, and can potentially result in the work platform falling from the bridge structure.

The need thus exists for an improved structure to suspend a work platform below a bridge girder. Such an improved structure preferably would provide a track that is securely clamped to the lower web of one or more bridge girders and a scaffold member having a plurality of rollers that roll along the upper surface of the track, with the scaffold member supporting the work platform thereon.

SUMMARY OF THE INVENTION

In view of the foregoing, an objective of the present invention is to provide a support structure that moveably supports a work platform underneath a bridge.

Another objective of the present invention is to provide a support structure that suspends a work platform from the underside of a bridge.

Another objective of the present invention is to provide a support structure that includes a track clamped to a bridge girder.

Another objective of the present invention is to provide a support structure having a track that is constructed of one or more track sections.

Another objective of the present invention is to provide a support structure having a track that is spaced a fixed, non-adjustable distance below a bridge girder.

Another objective of the present invention is to provide a support structure having a track clamped to a bridge girder, with the work platform being rollable along the track with one or more rollers.

Another objective of the present invention is to provide a support structure having a track clamped to a bridge girder, with a support surface having a roller and a pair of guide surfaces being rollable along the track, the roller being interposed between the guide surfaces, and the guide surfaces being spaced apart a distance greater than the width of the track.

Another objective of the present invention is to provide a support structure having a scaffold member that rolls along a track clamped to a bridge girder, the scaffold member supporting the work platform, the work platform being adjustable in the vertical direction on the scaffold member.

These and other objectives and advantages are obtained by the improved support structure for suspending a work surface below a girder of the present invention, the general nature of which may be stated as including at least a first clip, the at least first clip adapted to be mounted on the structural member, and a track mounted on said at least first clip.

Other objectives and advantages are obtained from the combination of the present invention, the general nature of which can be stated as including a pair of substantially parallel and spaced apart girders, the girders each having a lower web, a plurality of first clips mounted on one of the lower webs, each the first clip including a clamp portion, a bracket, and a compression member, the bracket mounted on the clamp portion, the compression member cooperating threadably with the clamp portion, the bracket being formed with a pair of holes, the compression member clamping the clip against one of the lower webs, a plurality of first track sections, each the first track section including a pair of pins, one of the pins being selectively receivable in one of the holes formed in one of the first clips, the other of the pins being selectively receivable in one of the holes formed in an adjacent first clip, a plurality of second clips mounted on the other of the lower webs, each the second clip including a clamp portion, a bracket, and a compression member, the bracket mounted on the clamp portion, the compression member cooperating threadably with the clamp portion, the bracket being formed with a pair of holes, the compression member clamping the clip against the other of the lower webs, a plurality of second track sections, each the second track section including a pair of pins, one of the pins being selectively receivable in one of the holes formed in one of the second clips, the other of the pins being selectively receivable in one of the holes formed in an adjacent second clip, a pair of scaffold members, one of the scaffold members disposed on at least one of the first track sections, the other of the scaffold members disposed on at least one of the second track sections, each the scaffold member including at least a first roller, a channel, a pair of suspension bars and a stringer, the at least first roller disposed in the channel, the suspension bars each being mounted on the channel, the stringer extending between the suspension bars, and a work platform, the stringers adapted to support the work platform.

Still other objectives and advantages are obtained by the method of the present invention, the general nature of which can be stated as including the steps of providing at least a first track non-adjustably mounted on a structural member and rollably hanging a work platform-from the at least first track.

BRIEF DESCRIPTION OF THE DRAWINGS

The preferred embodiment of the invention, illustrative of the best mode in which applicant has contemplated applying the principles of invention, is set forth in the following description and is shown in the drawings and is particularly and distinctly pointed out and set forth in the appended Claims.

Similar numerals refer to similar parts throughout the specification.

DESCRIPTION OF THE PREFERRED EMBODIMENT

The support assembly of the present invention is indicated generally at the numeral 2 in the accompanying figures. Support assembly 2 is used to suspend a work platform 4 from a pair of bridge girders 6. The suspension of work platform 4 from the underside of bridge girders 6 thus permits a workman to stand upon work platform 4 to remove construction forms from the underside of the roadway that is formed on the upper surface of bridge girders 6. It is understood, however, that support assembly 2 and the teachings set forth herein can be applied to virtually any type of work that is performed from the underside of a bridge or that requires a platform to be suspended from the underside of a bridge.

Figure 1:
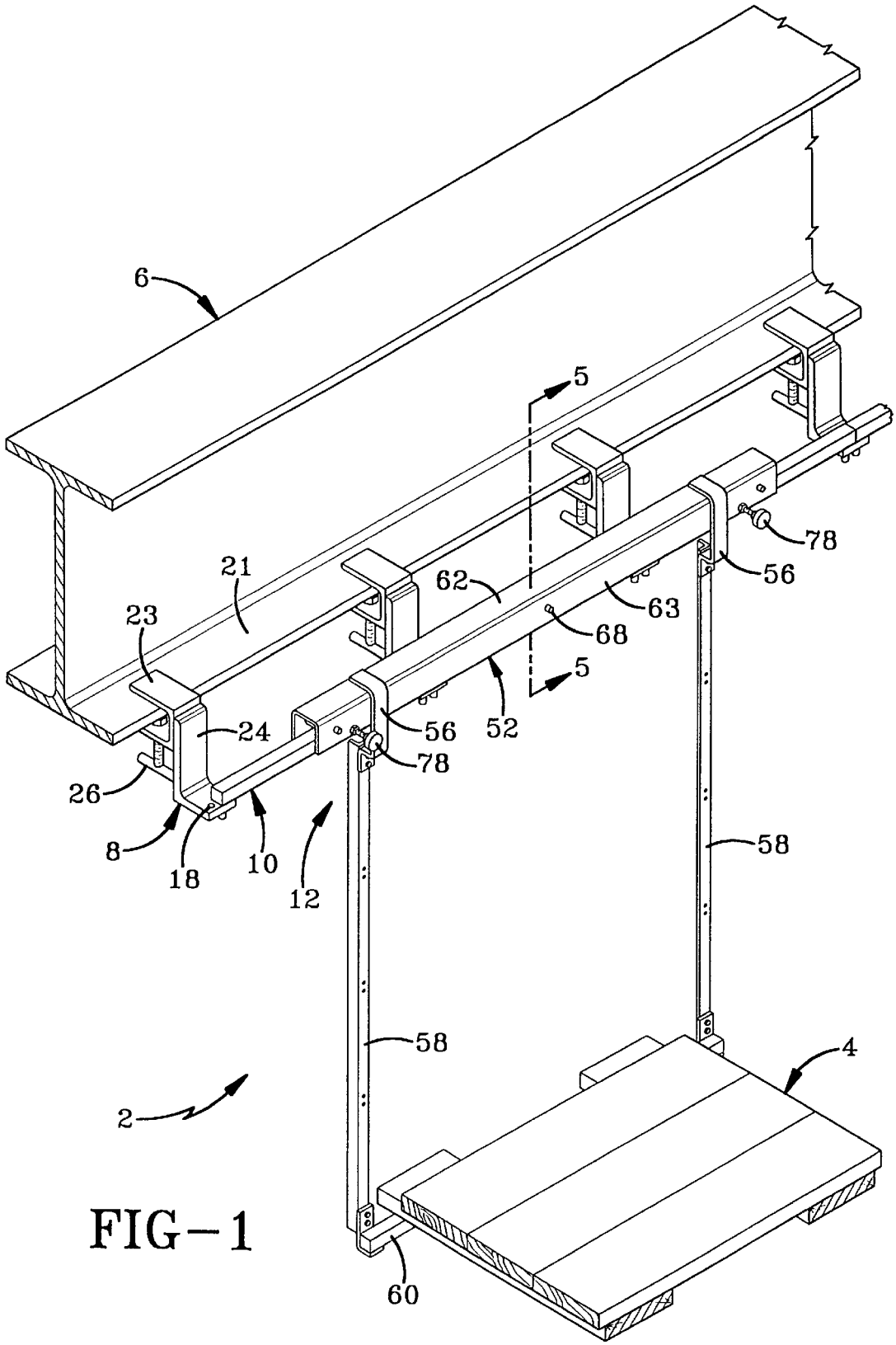
FIG. 1 is a perspective view of one-half of the support assembly of the present invention mounted on a bridge girder.
Figure 2:
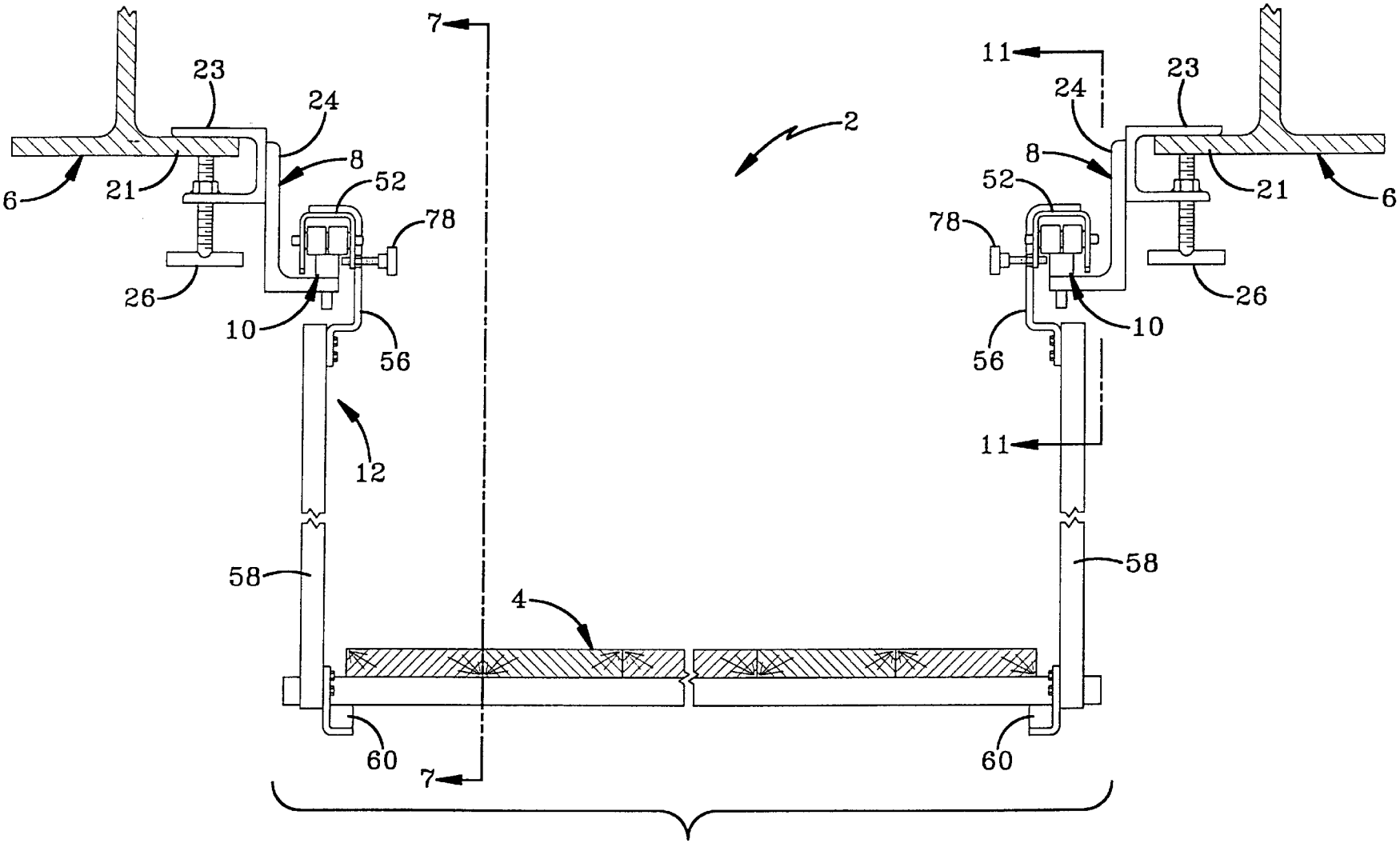
FIG. 2 is an end view of the support assembly of the present invention.

Support assembly 2 includes a plurality of clips 8 clamped onto bridge girders 6, a pair of tracks 10, and a pair of scaffold members 12. As is best shown in FIGS. 1 and 2, a set of clips 8 is attached to two bridge girders 6, with one of tracks 10 being mounted on each set of clips 8 adjacent bridge girders 6. Likewise, each scaffold member 12 hangs from one of tracks 10. Work platform 4 is supported by and extends between scaffold members 12.

Figure 3:
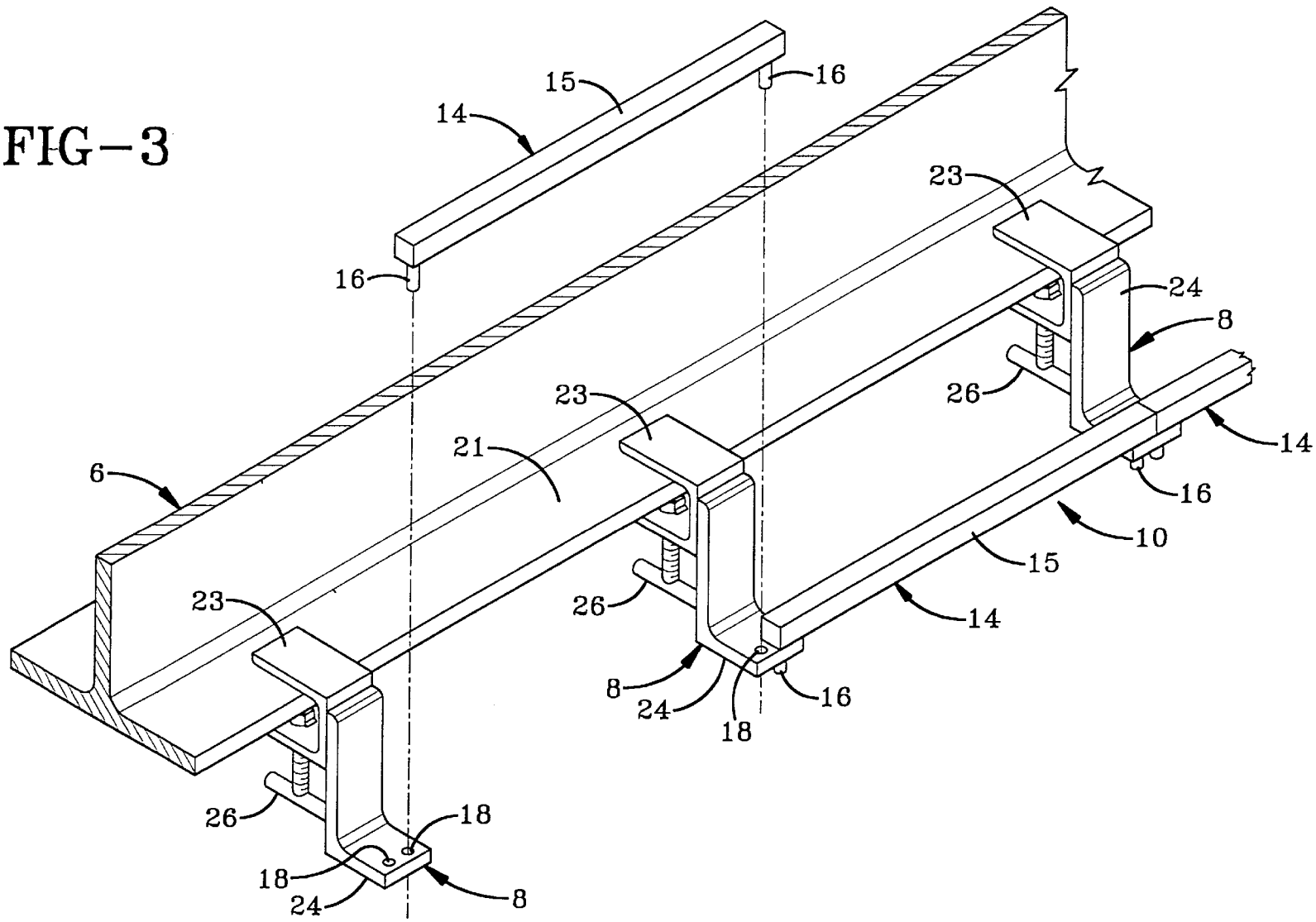
FIG. 3 is a perspective view of a portion of the track of the present invention.

As is best shown in FIG. 3, track 10 includes a plurality of track sections 14 that are selectively mounted on clips 8. Track sections 14 each include a bar 15 having a pair of parallel and spaced apart dowel pins 16 adjacent the ends of bar 15. Clips 8 are each correspondingly formed with a pair of parallel and spaced apart substantially cylindrical holes 18 that are sized to slidingly receive dowel pins 16 therein with minimal clearance. Dowel pins 16 of any given track section 14 extend between two adjacent clips 8 such that a plurality of clips 8 carry a plurality of track sections 14. While dowel pins 16 and holes 18 are of a substantially cylindrical shape, other configurations for dowel pins 16 and holes 18 may be appropriate depending upon the needs of the particular application. The configuration of clips 8 and track sections 14 thus provides a track 10 that is reliably supported below the lower surface of bridge girder 6.

Track sections 14 are provided in varying lengths that are selectively mounted onto clips 8 to enable support assembly 2 to be fitted to the specific configuration of girders 6 and the configuration of the bridge. For instance, the majority of track sections 14 used in assembling support assembly 2 are approximately two feet in length. Two foot lengths are conveniently used inasmuch as they are easy to transport and manipulate and since a two foot spacing between clips 8 is convenient forworkers to assemble. It is understood, however, that a different length may be used for the standard length of track sections 14 without departing from the spirit of the present invention.

Often girders 6 are not single continuous lengths of structural material, but rather are relatively shorter sections of structural material that are butted together and connected with one another by a junction plate 20. As is understood in the relevant art, a girder having a primarily downward force on it will receive one or more junction plates 20 disposed against and affixed to the upper and/or lower surfaces of the lower web 21 of bridge girders 6. While junction plates may be applied to the central web of girders 6, such centrally-disposed junction plates are subject to substantially reduced loading as compared with junction plates 20 disposed against lower web 21 of bridge girder 6.

Figure 4:
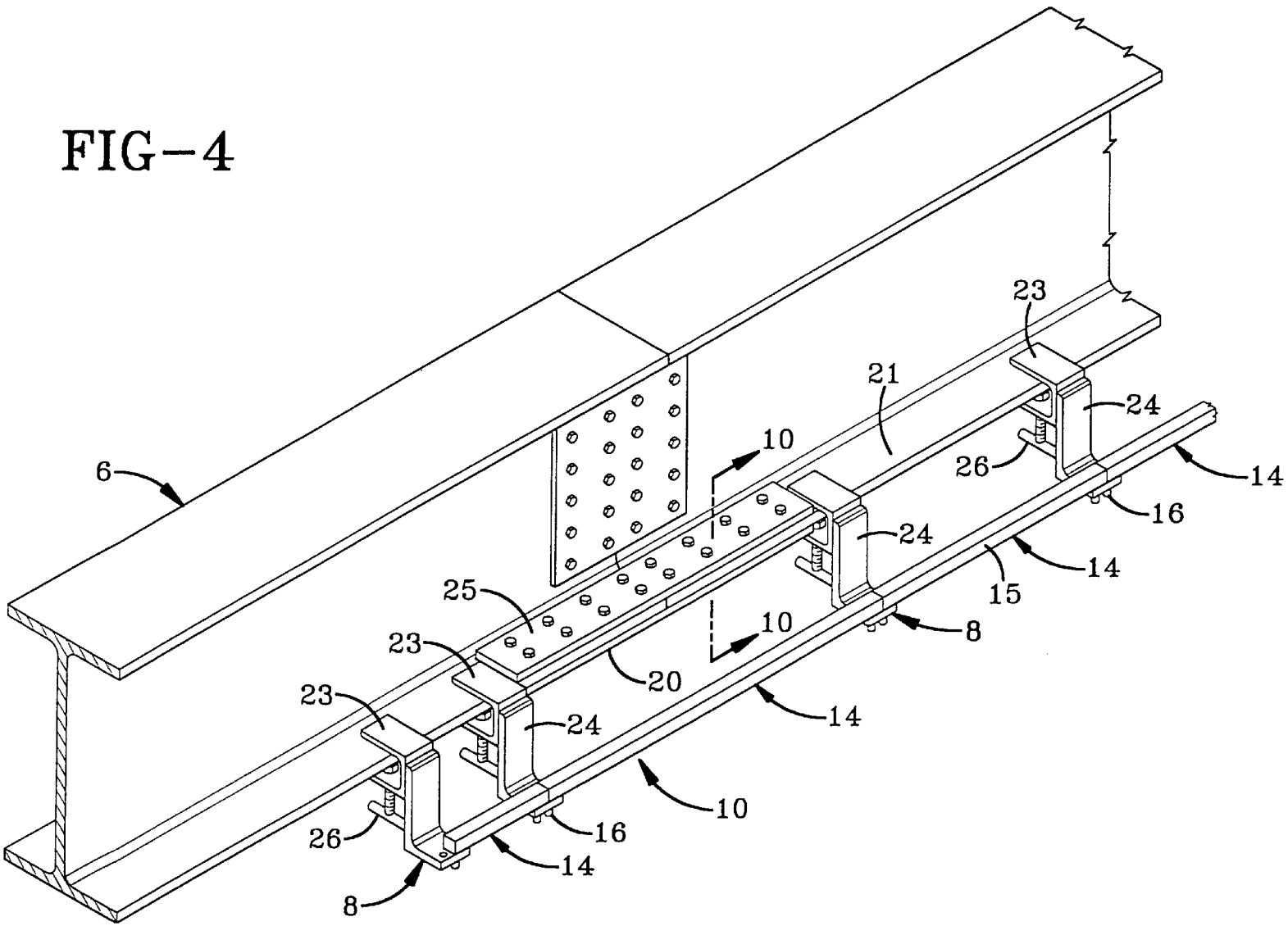
FIG. 4 is a perspective view of the track of the present invention spanning a bolted junction plate of a bridge girder.

As can be seen in FIG. 4, when junction plate 20 is bolted to web 21, an upper plate 25 is typically applied to the upper surface of lower web 21 on both sides of the central web. A plurality of bolts then extend through upper plates 25, lower web 21, and junction plate 20. Inasmuch as junction plates 20 are rarely longer than three feet in length, a section 14 that is three feet in length is used to traverse junction plate 20. Specifically, in traversing junction plate 20, clips 8 are clamped to bridge girder 6 on alternate sides of junction plate 20 such that track 10 continues past junction plate 20 without interruption or deviation. When junction plates 20 longer than three feet in length are encountered, special track sections 14 of the needed length are provided to span plates 20.

Figure 4A:
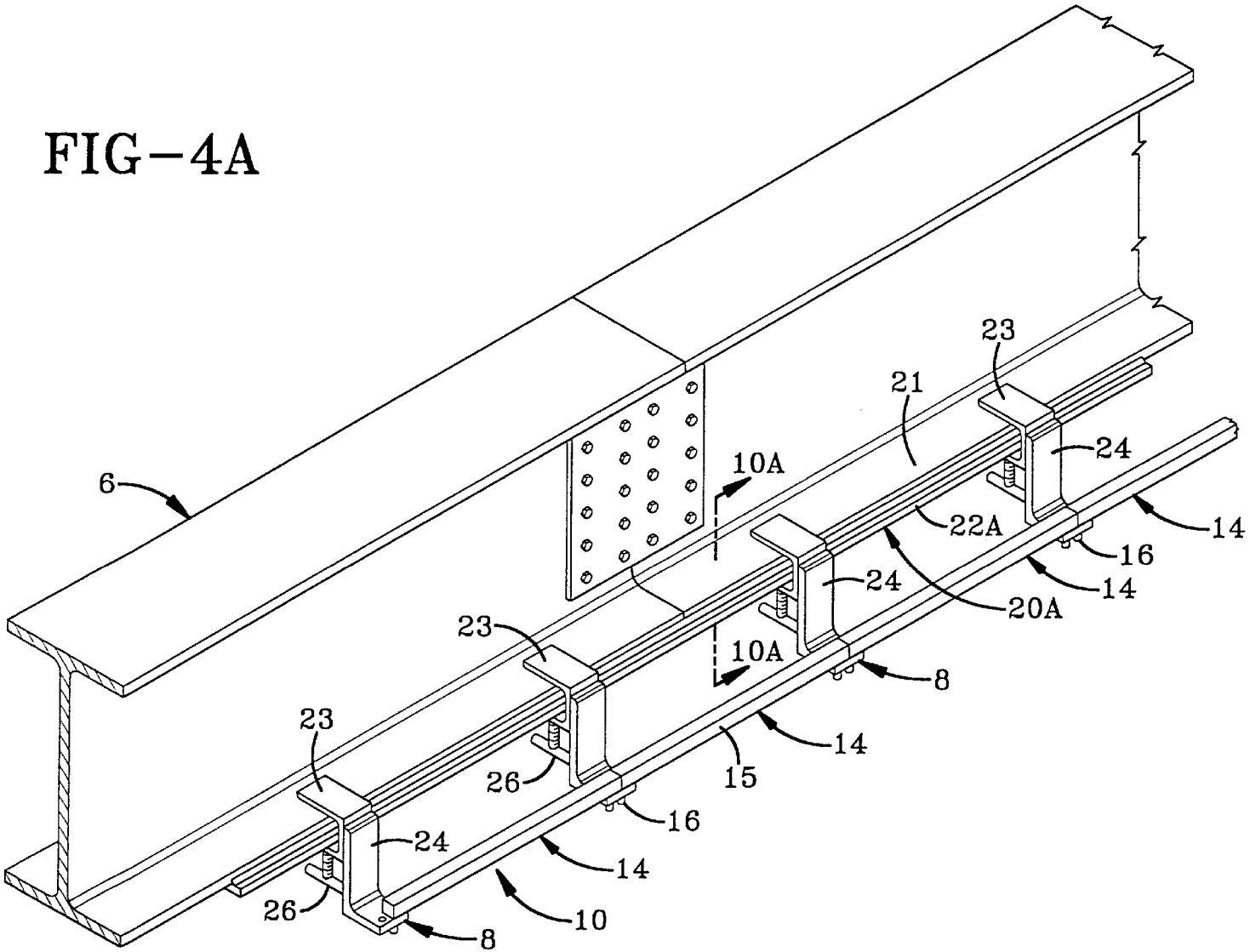
FIG. 4A is a perspective view of the track of the present invention spanning a welded junction plate of a bridge girder.

As can be seen in FIG. 4A, junction plate 20A may be welded to the underside of lower web 21. Welded junction plates 20A typically are on the order of eight feet in length and include a pair of protruding edges 22A that protrude outwardly from the outermost edges of lower web 21. Inasmuch as welded junction plates 20A are attached only to the underside of lower webs 21, clips 8 are installed over lower web 21 and welded junction plate 20A without interruption. Clips 8 thus support track 10 in an orientation generally parallel with and spaced below each bridge girder 6 regardless of the existence of junction plates 20 and 20A disposed at the lower surfaces of bridge girders 6.

Figure 5:
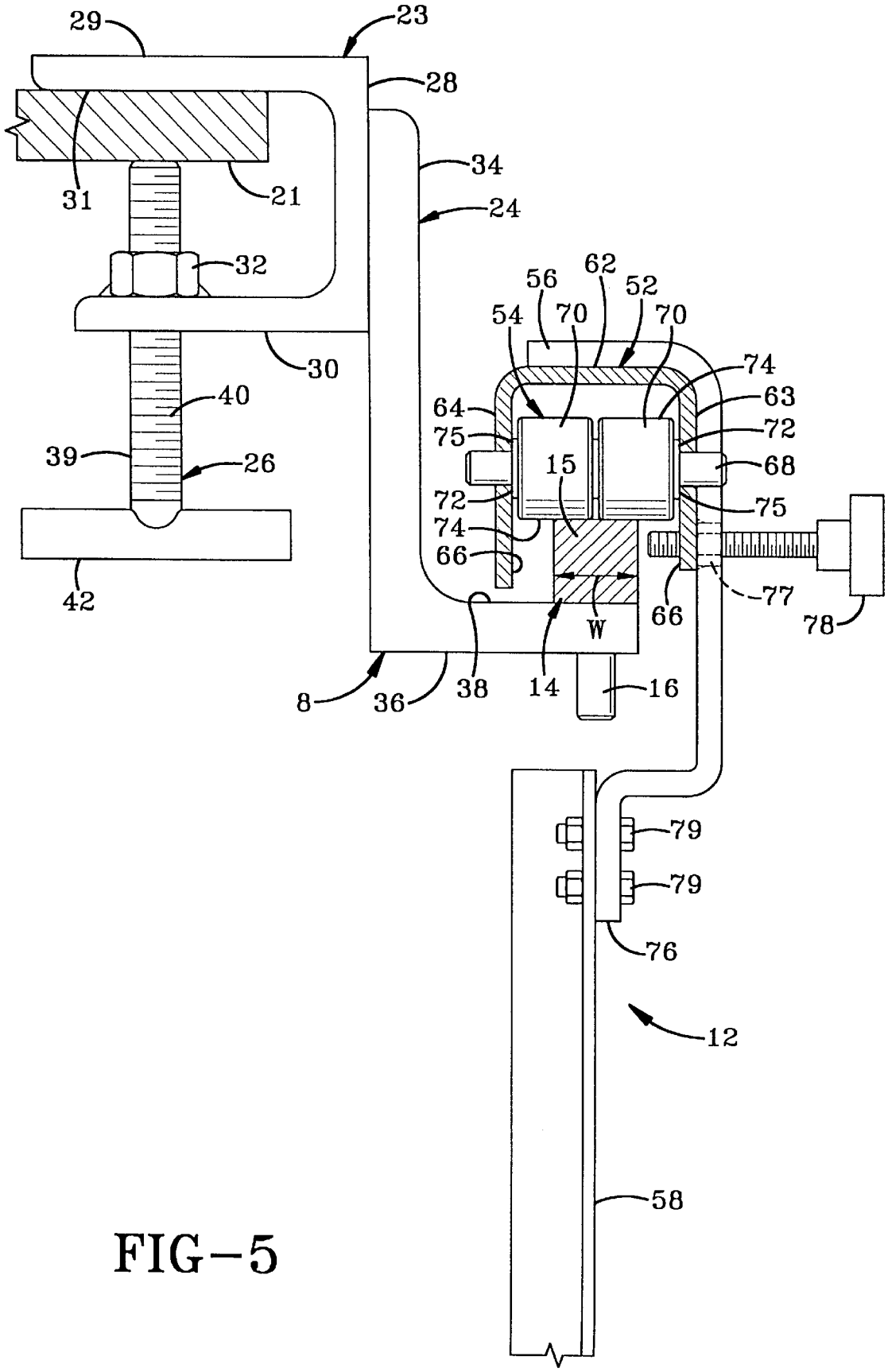
FIG. 5 is a sectional view as taken along line 5—5 of FIG. 1.

As is best shown in FIG. 5, clips 8 clamp securely to lower webs 21 of bridge girders 6. Clips 8 each include a clamp member 23, an L-shaped bracket 24 attached to clamp member 23, and a compression member 26 threadably mounted on clamp member 23. Clamp member 23 includes a base 28, a first ear 29, and a second ear 30. First and second ears 29 and 30 are parallel and spaced apart from one another and extend perpendicularly outward from alternate sides of base 28. A clamping surface 31 is disposed on the face of first ear 29 that faces toward second ear 30. Second ear 30 is formed with a substantially cylindrical hole therethrough and includes a nut 32 fixedly attached to the surface of second ear 30 that faces toward first ear 29. Nut 32 is formed with a plurality of internal threads and is oriented coaxially with the hole formed in second ear 30 to permit compression member 26 to be received therethrough.

Bracket 24 includes an attachment plate 34 fixedly attached to base 28 and a support plate 36 extending perpendicularly outwardly from an edge of attachment plate 34. A generally planar support surface 38 is disposed on an upper surface of support plate 36. Support surface 38 is parallel with clamping surface 31 and is spaced therefrom by a fixed, non-adjustable distance.

Holes 18 that accommodate dowel pins 16 are formed in support plate 36. When track sections 14 are mounted on clips 8, dowel pins 16 are received in holes 18, and bar 15 rests against support surface 38. Holes 18 are disposed with respect to each other such that track sections 14 are axially aligned with one another. Likewise, the generally planar nature of support surface 38 ensures that track sections 14 are vertically aligned with one another.

Compression member 26 includes an elongated substantially cylindrical body 39 having a plurality of external threads 40 formed thereon. External threads 40 are configured to cooperate threadably with the internal threads formed on nut 32. A handle 42 is preferably provided at the lower end of body 39 to facilitate the threading of compression member 26 through nut 32.

Figure 6:
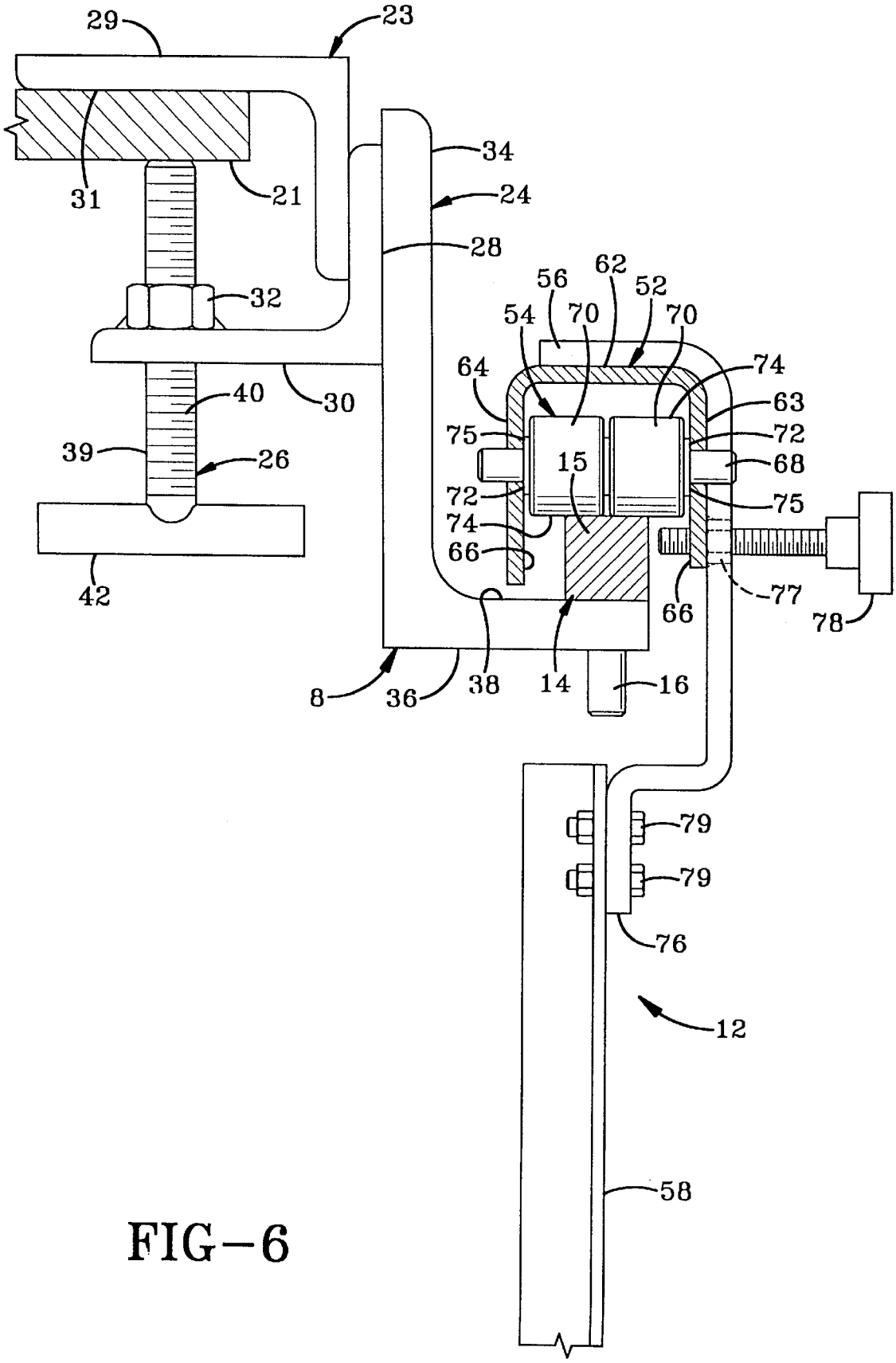
FIG. 6 is a view similar to FIG. 5, except showing a different configuration for the clip of the present invention.

An alternative configuration for clip 8 is depicted in FIG. 6 wherein clamp member 23 is constructed out of a pair of L-shaped angle sections attached to one another. In this regard, it is understood that clip 8 may be of numerous configuration so long as clip 8 is selectively clamped to web 21 of girder 6 and securely supports track 10 at a location below web 21.

Clip 8 is affixed to lower web 21 of bridge girder 6 by positioning clamping surface 31 against the upper surface of lower web 21 and threading compression member 26 through nut 32 until the tip of compression member 26 is compressed tightly against the lower surface of lower web 21. In such position, lower web 21 is tightly compressed between clamping surface 31 and compression member 26, and clip 8 is securely clamped to bridge girder 6, thus preventing movement of clip 8 with respect to bridge girder 6.

Scaffold member 12 includes an elongated channel 52, three rollers 54 disposed within channel 52, a pair of straps 56 fixedly attached and extending downwardly from channel 52, a suspension bar 58 attached to each of straps 56, and a stringer 60 (FIGS. 1–2) attached to and extending horizontally between suspension bars 58. Channel 52 includes a medial section 62, an inner guide 63, and an outer guide 64. Inner guide 63 and outer guide 64 are parallel and spaced apart from one another and extend perpendicularly outwardly from alternate sides of medial section 62. A pair of guide surfaces 66 are disposed on the surfaces of inner and outer guides 63 and 64 that face toward one another.

Rollers 54 each include an axle mounted on guides 64 and a pair of roller bearings 70 rollably mounted on axle 68 and interposed between guide surfaces 66. As is understood in the relevant art, roller bearings 70 each include a hollow, substantially cylindrical inner race 72 and a hollow, substantially cylindrical outer race 74 coaxial with one another and having a plurality of cylindrical rollers interposed therebetween. It is preferred that each inner race 72 terminates at a pair of annular ends 75 that protrude at least nominally past the ends of outer race 74. With roller bearings 70 interposed between guide surfaces 66, therefore, ends 75 of inner races 72 abut guide surfaces 66 such that outer races 74 nominally are spaced from guide surfaces 66 and away from one another. Outer races 74 are thus permitted to rotate with respect to axle 68 without friction against guide surfaces 66 and against one another. While a pair of roller bearings 70 are shown interposed between guide surfaces 66, it is understood that a single roller bearing extending between guide surfaces 66 may be employed without departing from the spirit of the present invention.

Axle 68 is preferably removably fastened to channel 52 such that axle 68 can be selectively removed from channel 52 to permit roller bearings 70 to be replaced as needed. Axle 68 may be removably mounted on channel 52 with known structures such as threaded nuts disposed on the exposed ends of axle 68, or any other structure that removably retains axle 68 on guides 64.

Straps 56 are fixedly attached to medial section 62 and inner guide 63. A tang 76 depends downwardly from the lower end of each strap 56 such that tangs 76 include an imaginary plane that is parallel with and spaced equally between guide surfaces 66.

Figure 5A:
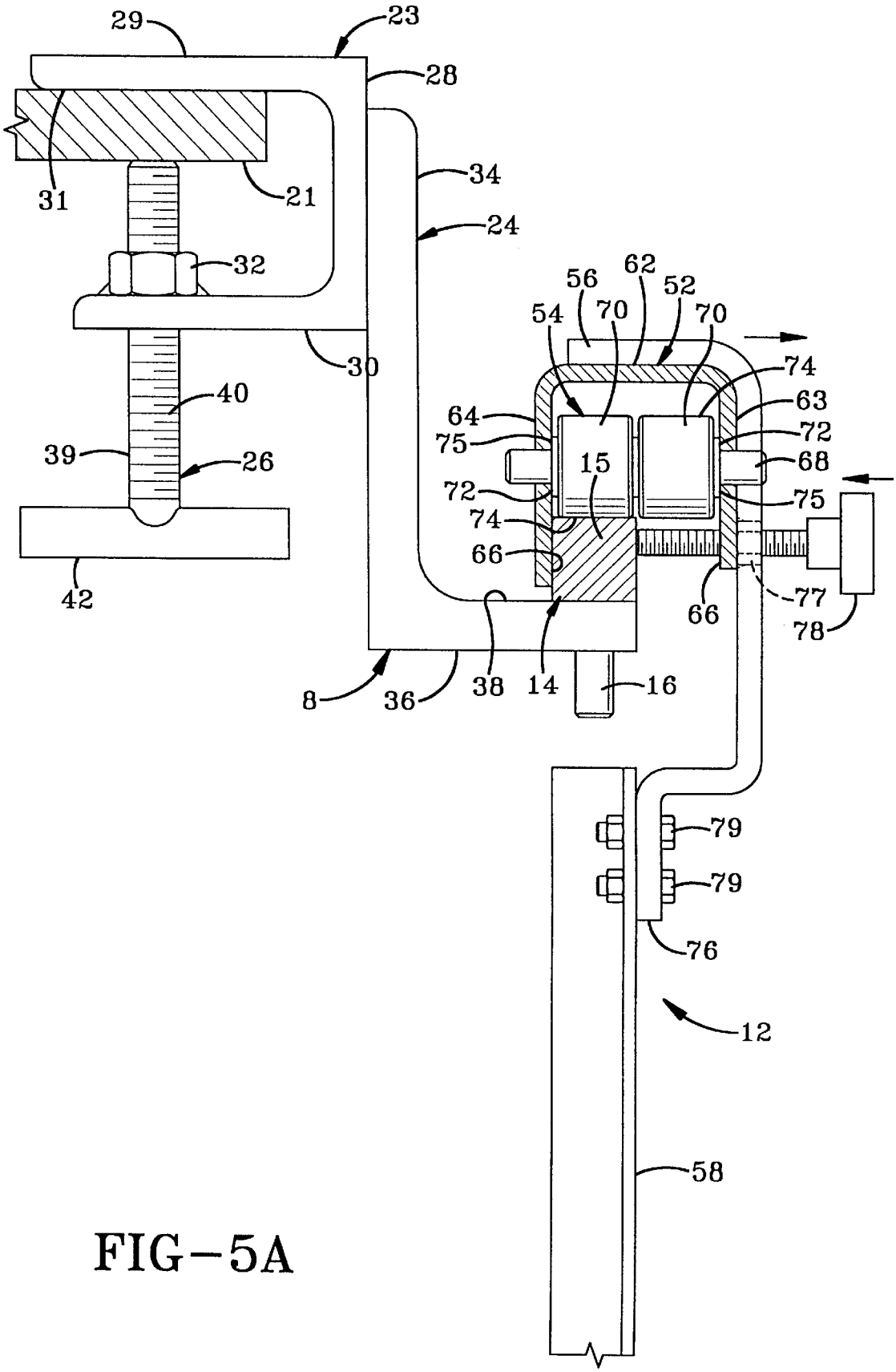
FIG. 5A is a view similar to FIG. 5, except showing the scaffold member clamped to the track.

Channels 52 are each formed with a pair of holes extending therethrough, with each hole having a nut axially disposed thereto and fixedly attached to channel 52. Nut 77 is formed with a plurality of internal threads that cooperate threadably with the external threads formed on a locking bolt 78. Locking bolt 78 may thus be threadably received through nut 77 and compressed against one of track sections 14. As is best shown in FIG. 5A, when locking bolt 78 is tightly compressed against track 10, track 10 is tightly compressed between locking bolt 78 and outer guide 64, thus locking scaffold member 12 in position with respect to track 10. Locking bolts 78 thus provide a locking mechanism that selectively prevents movement of work platform 4 along tracks 10. Movement of scaffold member 12 is permitted upon unthreading locking bolt 78 sufficiently to remove it from compression against track 10.

Figure 13:
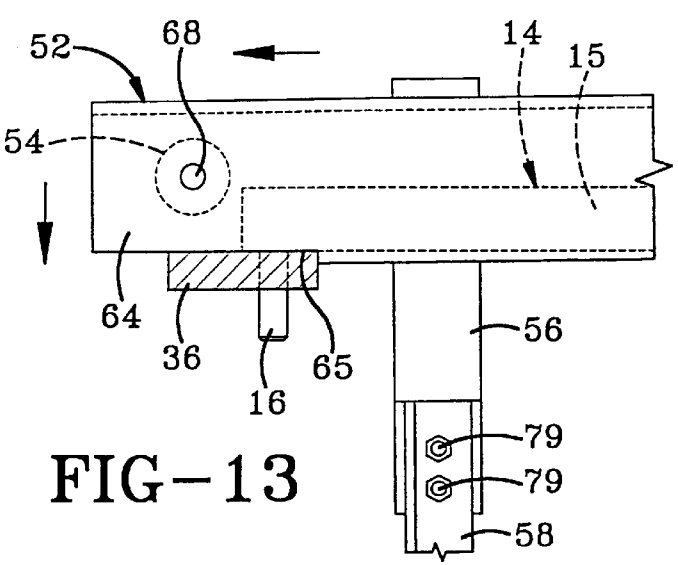
FIG. 13 is a view similar to FIG. 12, except showing the roller having fallen off the end of the track and the edge of the notch engaging the last clip.
Figure 12:
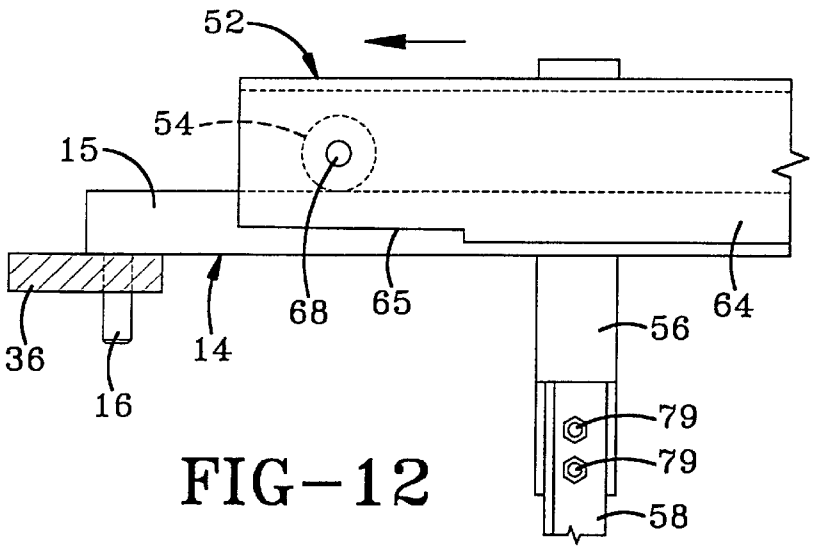
FIG. 12 is an enlarged view of the leftmost portion of FIG. 11.

A secondary locking capability is provided by outer guide 64. As is best shown in FIG. 12, the opposite ends of outer guide 64 are each formed with a notch 65 cut into the edge of outer guide 64 opposite its attachment with medial section 62. As can be seen in FIG. 13, if scaffold members 12 are permitted to roll past the end of track 10, the roller 54 will drop downward off the edge of the last track section 14 due to the weight of scaffold members 12 and any load carried on work platform 4, thus causing notch 65 to drop downwardly in conjunction therewith and frictionally engage the edge of clip 8. As long as rollers 54 roll along the upper surface of track members 14, notch 65 remains disposed above support surface 38 such that notches 65 remain out of engagement with clips 8. The secondary locking capability provided when notch 65 frictionally engages clip 8 prevents scaffold members 12 from rolling off the end of track 10 in the event of an emergency. In this regard, it is understood that notches 65 may be of virtually any configuration without departing from the spirit of the present invention.

Suspension bars 58 extend downwardly from tangs 76 and are each attached thereto with a pair of bolts 79. Suspension bars 58 are each elongated members that are each formed with a plurality of pairs of adjustment holes 80, the purpose of which will be set forth more fully below.

Stringer 60 is an elongated member, horizontally disposed, that terminates at a pair of gusset plates 82 disposed at opposite ends thereof. Gusset plates 82 are each formed with a pair of holes that are selectively alignable with one of the pairs of adjustment holes 80 formed in suspension bars 58. A pair of adjustment bolts 84 extend through the holes formed in each gusset plate 82 to mount stringer 60 to suspension bars 58.

Work platform 4 is supported on an upper surface of stringers 60. The upper surfaces of stringers 60 thus provide a support surface for supporting work platform 4 thereon. It is understood, however, that work platform 4 may be disposed on a different support surface defined on scaffold member 12 without departing from the spirit of the present invention.

Figure 7:
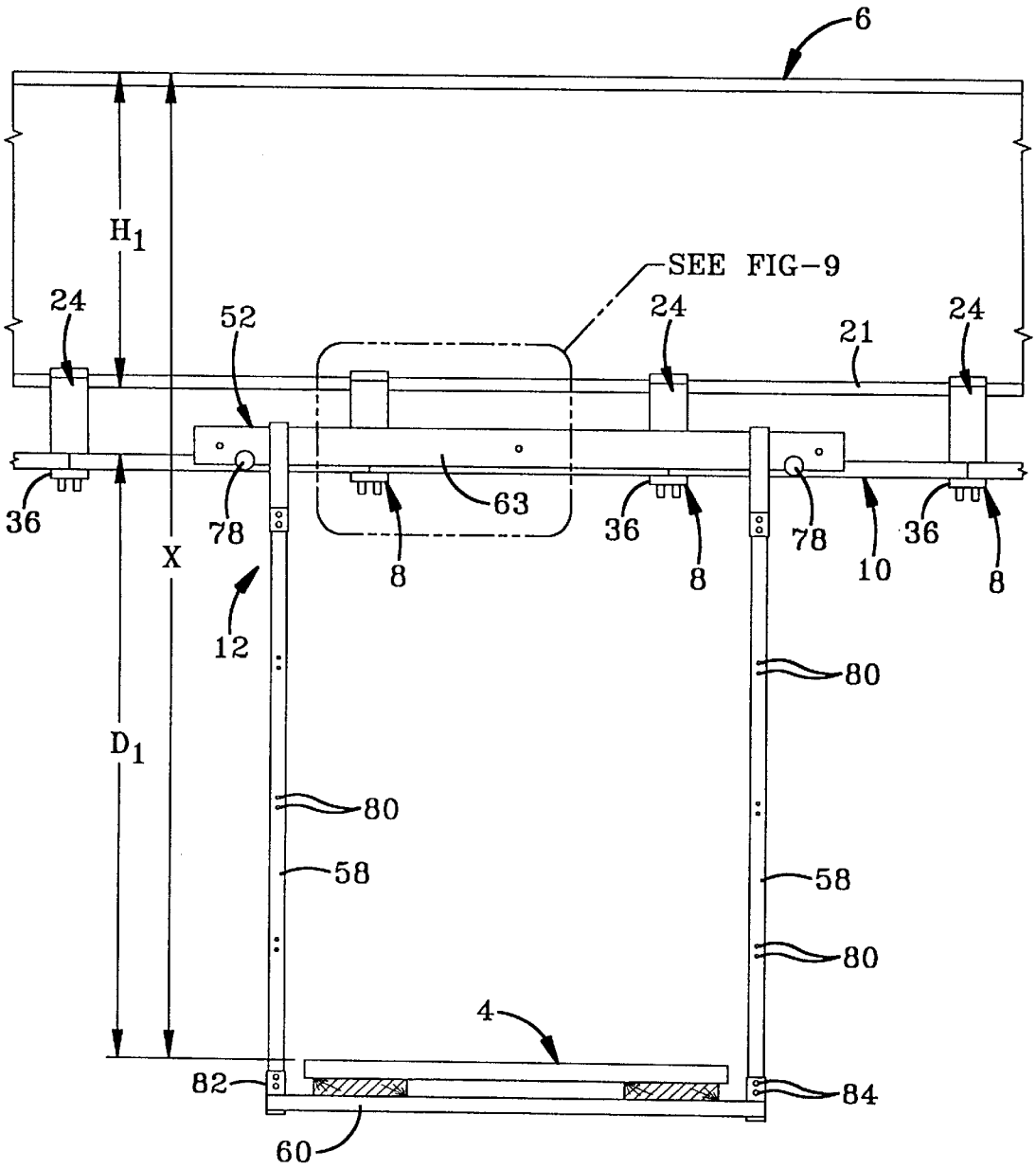
FIG. 7 is a sectional view as taken along line 7—7 of FIG. 2.
Figure 8:
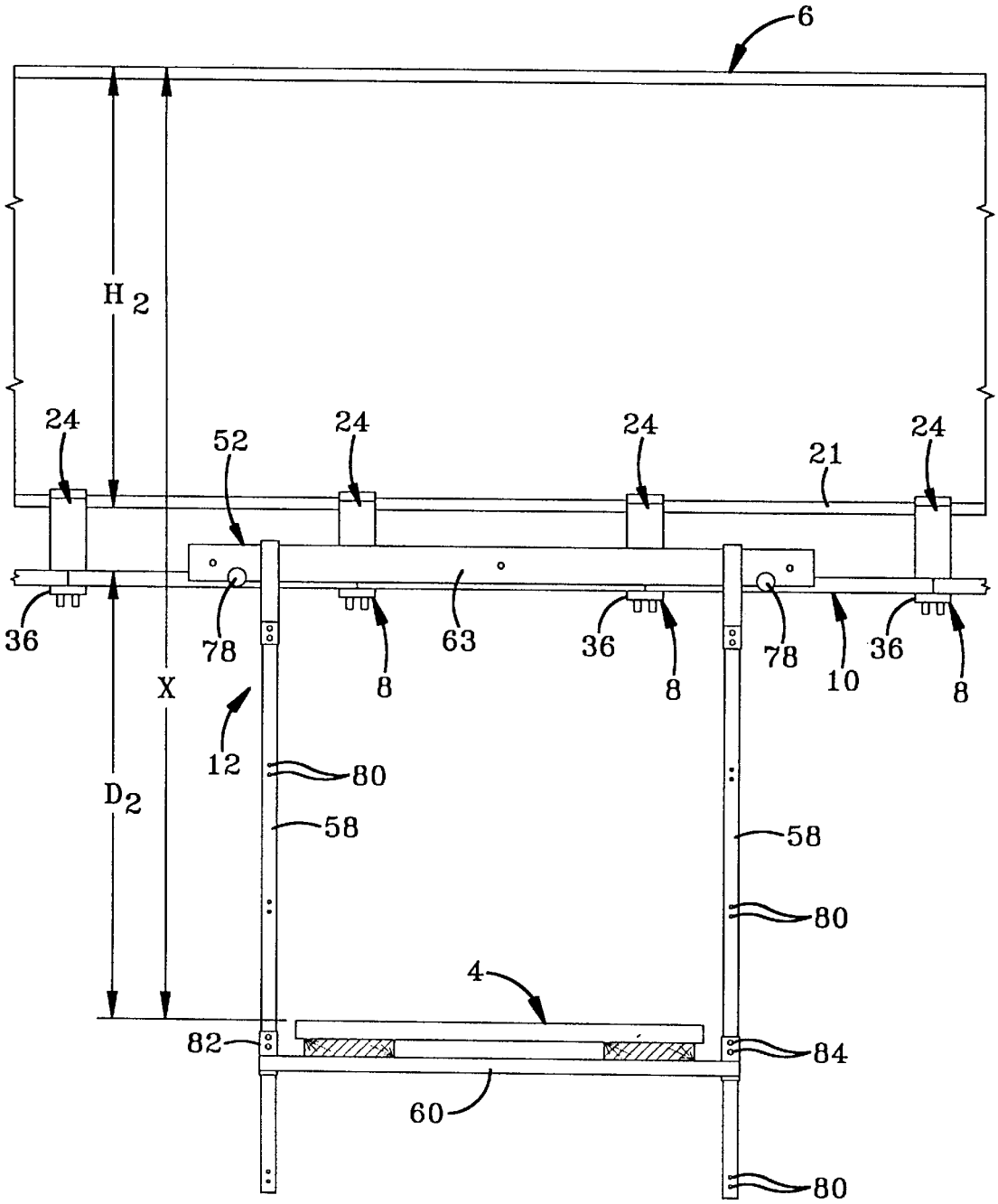
FIG. 8 is a view similar to FIG. 7, except showing the work platform adjusted to a different vertical position on the scaffold member.

As is shown in FIG. 7, when stringer 60 is mounted to the lowermost pair of adjustment holes 80 on suspension bars 58, the uppermost surface of work platform 4 is spaced below the upper surface of track 10 by a distance $D_1$. Bridges in any given region of the country typically include girders that are no smaller than a specific minimum height. Such a minimum height may be designated by the numeral $H_1$. Girders 6 may, of course, be larger, i.e., taller than this minimum height based upon factors such as the distance between the piers, the volume of traffic expected to travel over the bridge, as well as other factors. Such an increased girder height may be designated by the numeral $H_2$ (FIG. 8).

In using support assembly 2, it is preferred that the upper surface of work platform 4 be disposed a convenient distance below the upper surface of girders 6. Such a convenient distance would be the conventional height of a typical workman, i.e., six feet. Inasmuch as girders 6 of different bridges vary in height, the total distance between the upper surface of work platform 4 and the upper surface of girders 6 may be maintained at six feet by adjusting the position of work platform 4 with respect to suspension bars 58 to compensate for different sized girders. Suspension bars 58 are thus configured such that when stringer 60 is mounted in the lowermost pair of adjustment holes 80, the distance X between the upper surface of work platform 4 and the upper surface of the smallest prevalent bridge girder 6 is six feet. If girder 6 is of the type having a greater height $H_2$ than the aforementioned minimum height $H_1$, stringer 60 is raised such that the vertical distance between the upper surface of work platform 4 and the upper surface of girders 6 remains the same convenient working height X. It is understood, however, that the convenient working height X may be less than or greater than 6 feet without departing from the spirit of the present invention.

Inasmuch as girders 6 in a given geographic area are typically of a finite set of heights, pairs of adjustment holes 80 are disposed along the lengths of suspension bars 58 to correspond with girders 6 of given heights. Thus, if the minimum girder size of a given geographic area is thirty inches in height, and the only other girder heights that are prevalent in the same area are thirty six inches and forty inches in height, the lowermost pair of adjustment holes 80 formed in suspension bars 58 will provide a convenient working height X when support assembly 2 is attached to thirty inch girders. A pair of adjustment holes 80 will also be disposed six inches higher than the lowermost set of adjustment holes 80 (to correspond with a thirty-six inch girder), and another pair of adjustment holes 80 will be disposed ten inches above the lowermost pair of adjustment holes 80 (to correspond with a forty inch girder).

The distribution of the pairs of adjustment holes 80 on suspension bars 58 can be varied to accommodate the girder heights that are prevalent in any geographic area. Moreover, both ends of suspension bars 58 may be drilled with matching pairs of adjustment holes 80 as measured inwardly from either end to obviate the need that suspension bars 58 be oriented in a specific vertical orientation before being attached to straps 56 by bolts 79. With both ends of suspension bars 58 drilled with matching pairs of adjustment holes 80, scaffold members 12 can be assembled very quickly inasmuch as the workman assembling scaffold member 12 need not be concerned with inadvertently attaching one of suspension bars 58 to one of straps 56 in an upside down orientation that otherwise might necessitate disassembly of scaffold member 12.

Figure 9:
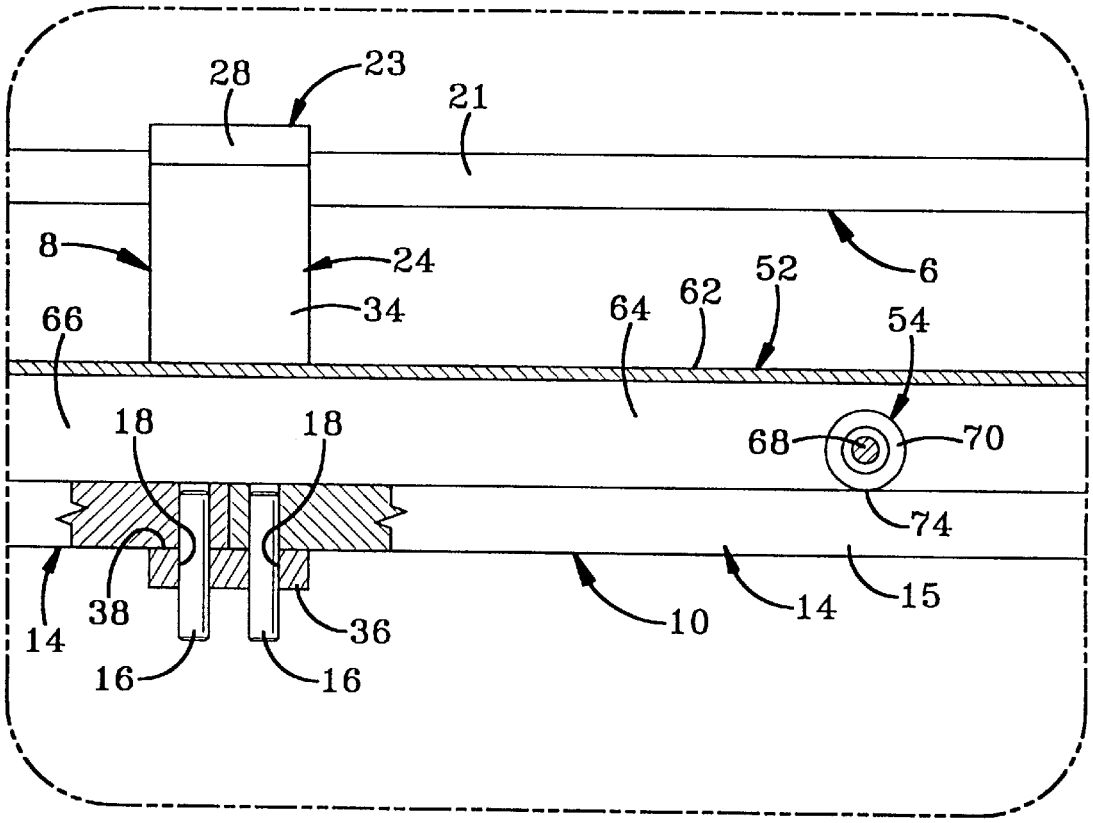
FIG. 9 is an enlarged view of the encircled portion of FIG. 7.
Figure 10:
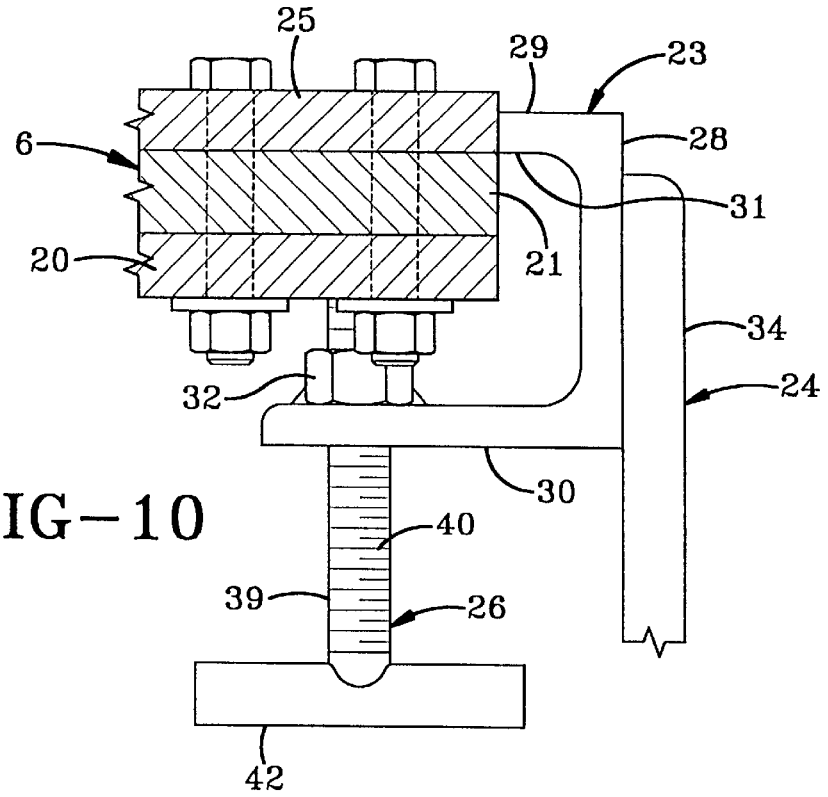
FIG. 10 is a sectional view as taken along line 10—10 of FIG. 4.
Figure 10A:
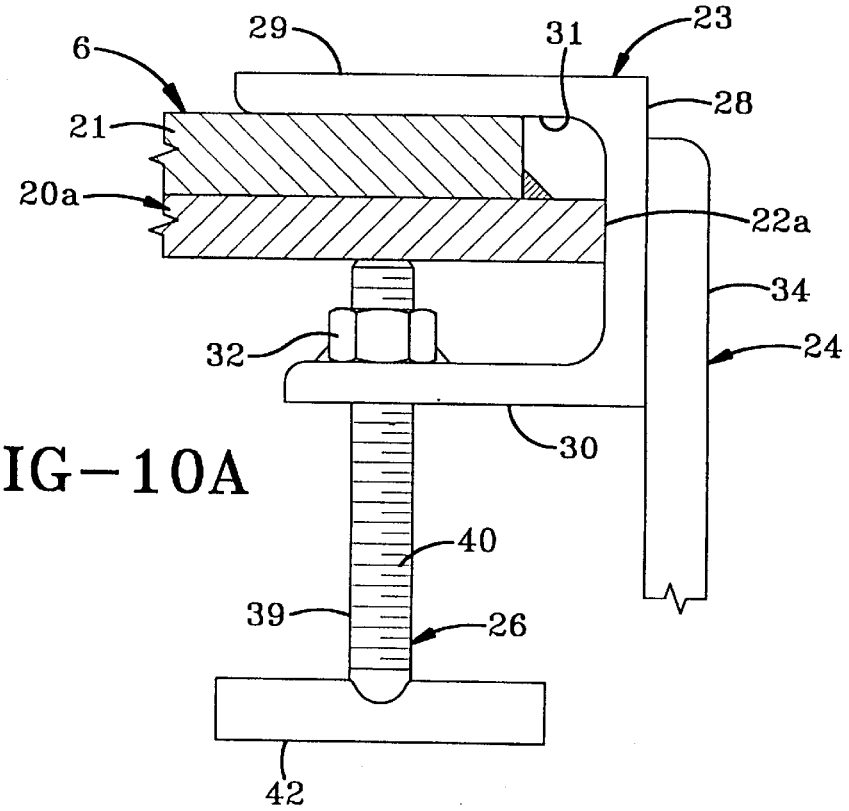
FIG. 10A is a sectional view as taken along line 10A—10A of FIG. 4A.
Figure 11:
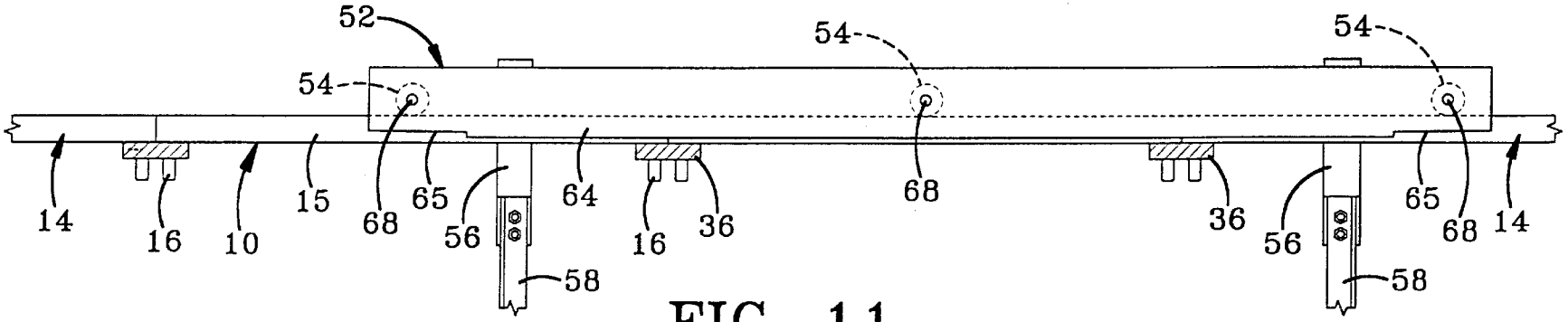
FIG. 11 is a sectional view as taken along line 11—11 of FIG. 2.

With clips 8 affixed to bridge girders 6, and tracks 10 mounted to each set of clips 8, scaffold members 12 may be rollably positioned atop the upper surface of track sections 14 and work platform 4 positioned on stringers 60. Scaffold members 12 may thus roll on rollers 54 along tracks 10, thereby moveably suspending work platform 4 below the bridge. Inasmuch as the ends of adjacent track sections 14 are only nominally spaced away from each other (FIG. 9), rollers 54 roll easily over the small gap between track sections 14 with minimal resistance. Once work platform 4 has been moved to a desired location underneath the bridge, locking bolts 78 are threaded through nuts 77 until locking bolts 78,are tightly compressed against track sections 14, thereby locking scaffold members 12 in position with respect to track 10.

As is best shown in FIGS. 5 and 6, guide surfaces 66 are spaced away from each other a distance significantly greater than the width W of track sections 14. Such extra space between guide surfaces 66 and track sections 14 is desirable to facilitate scaffold members 12 being rolled along track 10. More specifically, scaffold members 12 may not always be moved simultaneously along a bridge, thus causing channel 52 to become at least nominally misaligned with track 10. The additional space between guide surfaces 66 and track sections 14 thus prevents any misalignment between channel 52 and track 10 from binding scaffold member 12 on track sections 14 and inhibiting movement of work platform 4. Additionally, some of girders 6 are curved in the horizontal plane to permit the roadway above girder 6 to turn, such as when the bridge is part of an elevated on-ramp to a highway wherein the on-ramp is curved. In such a circumstance, track sections 14 will each be incrementally misaligned with one another, thus requiring the additional space provided between guide surfaces 66 and track sections 14 to prevent channel 52 from binding against track sections 14. Numerous other circumstances exist wherein channel 52 would otherwise be bound against track sections 14 in the absence of the space provided between guide surfaces 66 and track sections 14.

In accordance with the objectives of the present invention, the uppermost surface of scaffold member 12 is spaced below the lowermost surface of bridge girders 6. The spacing of scaffold members 12 below girders 6 prevents obstructions extending between girders 6 from interfering with the movement of scaffold members 12. For instance, the bridge may include diagonal cross members extending between the lowermost portion of the central web of one girder 6 and the uppermost portion of the central web of the adjacent girder 6. Additionally, horizontal cross members often are interposed between the lowermost regions of the central webs of adjacent girders 6. Such cross members would interfere with the movement of any scaffold member that extends above the uppermost surface of lower web 21. Inasmuch as scaffold members 12 are disposed below the lowermost surface of bridge girders 6, scaffold members 12 are free of interference with the aforementioned cross members.

Clips 8 are likewise immune from interference with such cross members. While clamping surfaces 31 of clips 8 are compressed against the upper surface of lower web 21, clips 8 are positioned around such cross members with the use of track sections 14 of differing lengths. The positioning of track 10 a distance below lower web 21 thus obviates conveyance problems that otherwise might occur if track 10 were otherwise positioned.

Inasmuch as dowel pins 16 are received in holes 18 with minimal clearance, track sections 14 are prevented from rotating about their longitudinal axis and are firmly retained against support surfaces 38 of clips 8. Dowel pins 16 thus provide retention structures for retaining track sections 14 in position on clips 8. Likewise, holes 18 formed in clips 8 provide receptacles that receive the retention structures provided by dowel pins 16. It is understood that dowel pins 16 could be formed on clips 8, and holes 18 formed on track sections 14, depending upon the needs of the configuration, without departing from the spirit of the present invention. It is likewise understood that the retention structures and receptacles could have alternate configurations without departing from the spirit of the present invention.

Support assembly 2 thus moveably suspends work platform 4 from the underside of a bridge. The space provided between guide surfaces 66 and track sections 14 eliminates binding that might otherwise occur if channels 52 become misaligned with track sections 14. Moreover, adjacent sections of track 14 are minimally spaced from one another to provide a substantially continuous track 10 over which rollers 54 can roll with minimal resistance. Additionally, the positioning of tracks 10 such that scaffold members 12 are spaced below lower webs 21 eliminates the possibility of interference between scaffold members 12 and cross members extending between adjacent girders 6. The adjustability of stringers 60 on suspension bars 58 permits work platform 4 to be easily adjusted to compensate for bridge girders 6 of different heights. Locking bolts 78 retain scaffold members 12 in position with respect to track 10, thus preventing unwanted movement of work platform 4.

Support assembly 2 additionally obviates the need for "leapfrogging" inasmuch as clips 8 and track sections 14 can be installed in a single procedure and need not be removed immediately after scaffold members 12 have passed over them. As such, once clips 8 and track sections 14 have been installed onto girders 6, scaffold members 12 can be selectively rolled in either direction along track 12 without the need to install or re-install additional clips 8 and track sections 14 in the desired direction.

Accordingly, the improved support structure for suspending a work surface below a girder apparatus is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the support structure for suspending a work surface below a girder is constructed and used, the characteristics of the construction, and the advantageous new and useful results obtained; the new and useful structures, devices, elements, arrangements, parts, and combinations are set forth in the appended Claims.

We claim:

1. A support assembly for movably suspending a work platform from a structural member, said support assembly comprising:

first, second and third L-shaped clips adapted to be mounted on the structural member; and an elongated track mounted on said first, second and third clips;

wherein said elongated track comprises at least a first and a second elongated track section, and said first and second elongated track sections each have a first and second alignment feature, and the first L-shaped clip has at least one alignment feature which is engaged by the first alignment feature on the first elongated track section; the second L-shaped clip has a first alignment feature and second alignment feature, wherein the first alignment feature of the second L-shaped clip is engaged by the second alignment feature of the first elongated track section, and the second alignment feature of the second L-shaped clip is engaged by the first alignment feature of the second elongated track section; and the third L-shaped clip has at least one alignment feature which is engaged by the second alignment feature of the second elongated track section, whereby the first and second elongated track sections are positioned in longitudinal alignment, and said L-shaped clip alignment features each comprise a first retention structure disposed on said L-shaped clips, and said elongated track section alignment features each comprise a retention structure being selectively engageable with a respective one of said first retention structures.

2. The support assembly as set forth in claim 1, wherein said at least first track section is selectively removably mounted on said at least first clip.

3. The support assembly as set forth in claim 2, further comprising a retention structure disposed on one of said at least first clip and said at least first track section, the other of said at least first clip and said at least first track section being formed with a receptacle, said retention structure being selectively receivable in said receptacle.

4. The support assembly as set forth in claim 1, further comprising a scaffold member, said scaffold member being movably mounted on said track.

5. The support assembly as set forth in claim 4, further comprising at least a first roller rollably mounted on said scaffold member, said at least first roller being rollably disposed on said track.

6. The support assembly of claim 5, wherein a channel is superimposed over said track, and two suspension bars depend from said channel to support a work platform.

7. The support assembly as set forth in claim 5, further comprising a pair of guide surfaces extending from said scaffold member, said at least first roller being interposed between said guide surfaces, said guide surfaces being separated from one another by a distance greater than the width of said track.

8. The support assembly as set forth in claim 7, further comprising a support surface disposed on said scaffold member, said support surface adapted to support the work platform.

9. The support assembly as set forth in claim 8, further comprising at least a first suspension bar and a stringer, said at least first suspension bar being mounted on said scaffold member, said stringer being mounted on said suspension bar, said support surface being disposed on said stringer.

10. The support assembly as set forth in claim 9, wherein said stringer is vertically adjustable on said scaffold member.

11. The support assembly as set forth in claim 9, wherein said at least first suspension bar is formed with a plurality of holes, said stringer being adjustably mounted to said at least first suspension bar by being selectively mounted to at least a first of said holes.

12. The support assembly as set forth in claim 4, wherein said scaffold member is disposed on said track such that the upper surface of said scaffold member is adapted to be disposed below the lower surface of the structural member.

13. The support assembly as set forth in claim 4, further comprising at least a first locking bolt mounted on said scaffold member, said at least first locking bolt selectively lockingly engaging said scaffold member in position on said track.

14. The support assembly as set forth in claim 13, wherein said at least first locking bolt is threadably mounted on said scaffold member.

15. The support assembly as set forth in claim 4, wherein said scaffold member is formed with at least a first notch, said at least first notch being selectively frictionally engageable with said at least first clip to stop the movement of said scaffold member.

16. The support assembly as set forth in claim 1, wherein said at least first clip includes a clamping surface, said clamping surface adapted to be clamped against a lower web of the structural member.

17. The support assembly as set forth in claim 16, further comprising a compression member, said compression member adapted to compress said clamping surface against the lower web of the structural member.

18. The support assembly as set forth in claim 17, wherein said compression member is a threaded member that is threadably mounted on said at least first clip.

19. The support assembly as set forth in claim 1, wherein there is a third elongated track section which has at least one alignment feature comprising a retention structure and the third L-shaped clip has a second alignment feature comprising a retention structure and the alignment feature of the third elongated track section engages the second alignment feature on the third L-shaped clip.

20. The support assembly as set forth in claim 19, wherein the retention structure on the third elongated track section is a pin and the retention structure feature on the third L-shaped clip is a hole.

21. The support assembly as set forth in claim 20, wherein the pin is vertical and the hole is vertical.

22. The support assembly as set forth in claim 1, wherein the retention structures on the first and second elongated track sections are pins, and the retention structures on the first, second and third L-shaped clips are each holes which are engageable by said pins.

23. The support assembly as set forth in claim 22, wherein the pins are vertical and the holes are vertical.

24. The support assembly as set forth in claim 1, wherein a channel is superimposed over said track and said channel is mounted on rollers on said track, and two suspension bars depend from said channel to support a work platform.

25. The support assembly of claim 24, wherein the rollers are sufficiently wide to extend substantially across the channel.

26. The support assembly of claim 1, wherein the support assembly moves in substantially a parallel direction relative to the structural member.

* * * * *